United States Patent [19]

Choi

[11] Patent Number: 5,050,773

[45] Date of Patent: Sep. 24, 1991

[54] ELECTRIC TOOTHPASTE DISPENSER

[76] Inventor: Min K. Choi, 21710 Park Valley, Katy, Tex. 77450

[21] Appl. No.: 478,412

[22] Filed: Feb. 12, 1990

[30] Foreign Application Priority Data

Jun. 12, 1989 [KR] Rep. of Korea ..... 18497

[51] Int. Cl.[5] ..... B65D 35/28

[52] U.S. Cl. ..... 222/63; 222/102

[58] Field of Search ..... 222/52, 63, 93, 94, 222/101, 102, 105, 325, 333, 405

[56] References Cited

U.S. PATENT DOCUMENTS

| | | | |
|---|---|---|---|
| 2,563,733 | 8/1951 | Meczelski | 222/93 |
| 3,198,389 | 8/1965 | Dunning | 222/93 |
| 3,313,454 | 4/1967 | Welsh et al. | 222/105 |
| 4,234,104 | 11/1980 | Apuzzo, Jr. et al. | 222/94 |
| 4,258,864 | 3/1981 | Karamanolis et al. | 222/96 |
| 4,403,714 | 9/1983 | Kane | 222/101 |
| 4,421,252 | 12/1983 | Ylitalo | 222/105 |
| 4,508,242 | 4/1985 | Wolfe | 222/102 |
| 4,629,095 | 12/1986 | Smith | 222/96 |

*Primary Examiner*—Michael S. Huppert
*Assistant Examiner*—Anthoula Pomrening
*Attorney, Agent, or Firm*—Mark A. Oathout; John R. Kirk, Jr.

[57] ABSTRACT

The present invention relates to a toothpaste dispensing apparatus which includes a housing having an adaptable nozzle at the top of the housing and two adaptable grasping assemblies located within the housing for holding the toothpaste container. A drive assembly is mounted within the housing and drives a carriage for squeezing along the length of the toothpaste container. A control system is also included for activating the drive assembly and for automatic reversal of the drive assembly.

14 Claims, 5 Drawing Sheets

ELECTRIC TOOTHPASTE DISPENSER

SUMMARY OF THE INVENTION

The present invention generally relates to an electric toothpaste dispenser and, more particularly, is concerned with a toothpaste dispenser which is operated by depressing a button with a toothbrush. When the dispenser is empty a user merely replaces the toothpaste container.

DESCRIPTION OF THE PRIOR ART

The typical toothpaste tube in use today has been in use for many years after gaining wide acceptance. This typical toothpaste tube is relatively easy to use although it has a few shortcomings. Some of the shortcomings include leakage from the tube due to cracks and tears forming in the walls of the tube, leakage between the mouth and the cap of the tube due to the combination of failing to properly tighten the cap onto the tube and the placement of improper pressure upon the tube, wasted toothpaste remaining in the tube due to uneven squeezing or rolling of the tube, the inconvenience of unscrewing and replacing a cap every time toothpaste is to be used and problems related to the application of too much pressure to the tube resulting in additional wasted toothpaste and toothpaste spillage onto the counter and sink. All of these problems are compounded when the toothpaste tube is used by children.

There are also certain individuals who gain satisfaction through the use of electric gadgets in the home. Such individuals may find the installation of an electrically driven toothpaste dispenser to be pleasing Several toothpaste dispensing apparatii have been disclosed in the past U.S Pat. No. 3,198,389 to Dunning discloses a toothpaste dispensing cabinet which uses two rollers to roll down a tube of toothpaste. U.S. Pat. No. 4,234,104 to Apuzzo et al describes a toothpaste dispenser having a motor for driving two rollers down a tube of toothpaste. The outlet from the dispenser includes a closure and a manually operated switch is included to reverse the motor. U.S. Pat. No. 4,258,864 to Karamanolis et al describes a toothpaste dispenser with a motor which drives a roller down a tube of toothpaste. A manually operated switch is used to retract the roller and a gate is used to close off the outlet. U.S. Pat. No. 4,403,714 to Kane describes a toothpaste dispenser with a motor driven roller which compresses paste out of a horizontally mounted tube of paste. The tube is threaded into an adapter and the outlet is covered by a lever 21. The motor is reversed by a manual switch. U.S. Pat. No. 4,629,095 to Smith describes a toothpaste dispenser which is carried by a wheel for driving the tube through a pair of pinch rollers. The tube of paste is inverted and threaded into an aperture which is closed off by a flap closer.

The patents described above have several shortcomings. They fail to recognize the importance of having pliable rollers which will provide an evenly distributed squeeze across the tube. Resiliency in the rollers is desired to accommodate different sized tubes and obstructions in the tubes. While some of the patents do mention that the rollers may be spring mounted, they fail to recognize that spring created resiliency will result in an imbalanced or uneven squeeze across the tube. Another problem is that these patents fail to provide drive to the rollers. Only the patent to Dunning, U.S. Pat. No. 3,198,389, provides rotational drive to the rollers. However, the drive is provided by a pulley system which will be expensive to construct and will encounter problems due to slippage of the pulley.

These patents also have drawbacks relating to the guidance of the toothpaste tube between the rollers when the rollers begin at the bottom of the tube and when the tube is improperly aligned or oriented with respect to the rollers. These drawbacks are important since a dispenser must accommodate various sizes of toothpaste tubes as well as bent toothpaste tubes and adjust for improperly aligned toothpaste tubes. Additionally, these patents fail to address problems related to the rollers forcing the tube to collapse against the housing or the outlet or pulling the tube out of the outlet due to the reversal of the rollers or frictional forces from the rollers. These patents also require that a switch be manually activated, as opposed to automatically activated, to reverse a roller assembly which has completed its compressing motion across the toothpaste tube.

Other problems include the placement of the outlet at the bottom of the housing. This requires that the toothpaste tube be placed in an inverted position which in turn requires that a closure device be placed at the outlet to prevent toothpaste from seeping out of the dispenser due to gravity Additionally, no device is described for adapting to, connecting to and holding the tube within the housing. Since toothpaste tubes are made of various sizes and designs it is important to include adjustable or adaptable structures to hold the tube and to connect to the mouth of the tube. The patents described above further fail to recognize the importance of making the outlet nozzle removable so that clogged toothpaste can be removed.

Further shortcomings include the failure to recognize other features which can be added for ease of operation of the dispenser including the addition of an easily accessible button which will activate the dispenser by pressing down with the back side of a toothbrush. The patents above which use a toothbrush activated lever will result in toothpaste being rubbed on or transferred to the surrounding housing and accessory structure. The dispenser can also be made more convenient by including a wall mount and a toothbrush holder which is mounted on the outside for accessibility while being removable for ease of cleaning. Additionally, these patents use alternating current to power the motor which increases the risk of electrocution.

The need therefore exists for an electric toothpaste dispenser which is easily mountable and accessible for holding toothbrushes while allowing for cleaning, which prevents the likelihood of electrocution through the use of a d/c converter, which will provide proper and efficient drive to the rollers, which will provide an even and pliable squeeze to the tube of toothpaste, which will hold a tube of toothpaste in the upright position while being adaptable to accommodate various sizes and designs of toothpaste tubes and which will allow for ease of controlling the dispenser without a mess due to toothpaste being rubbed onto parts of the dispenser.

SUMMARY OF THE INVENTION

The present invention provides an electric toothpaste dispenser designed to satisfy the aforementioned needs. The dispenser includes pliable rollers to apply a balanced and even squeeze across the toothpaste tube. Guide plates are located above the rollers to guide the toothpaste tube between the rollers when the rollers begin at the bottom of the toothpaste tube. The rollers and the drive assembly are designed such that the upward force created by the carriage assembly ascending along the toothpaste tube and the downward force created by friction between the rollers and the toothpaste tube will sufficiently balance out so that the toothpaste tube will remain in place without collapsing while the rollers ascend along the toothpaste tube. The tube will also remain in place when the rollers reverse and the carriage descends. When the rollers have reached the top of the tube, the control system will automatically reverse the motor so that the rollers roll back down below the tube. The outlet nozzle from the housing is placed at the top of the housing so that no closure device will be needed for the outlet nozzle. The outlet nozzle is adaptable to the mouth of the tube and the tube is adjustably held. If the outlet nozzle becomes clogged, it can be removed for soaking. The present invention includes additional important accessories including an easily accessible activation button, a wall mount, a removable toothbrush holder and a d/c converter.

Accordingly, the present invention relates to a toothpaste dispensing apparatus which includes a housing having an adaptable nozzle at the top of the housing and two adaptable grasping assemblies located within the housing for holding the toothpaste container. A drive assembly is mounted within the housing and drives a carriage for squeezing along the length of the toothpaste container. A control system is also included for activating the drive assembly and for automatic reversal of the drive assembly.

DETAILED DESCRIPTION OF THE INVENTION

Figure 2:
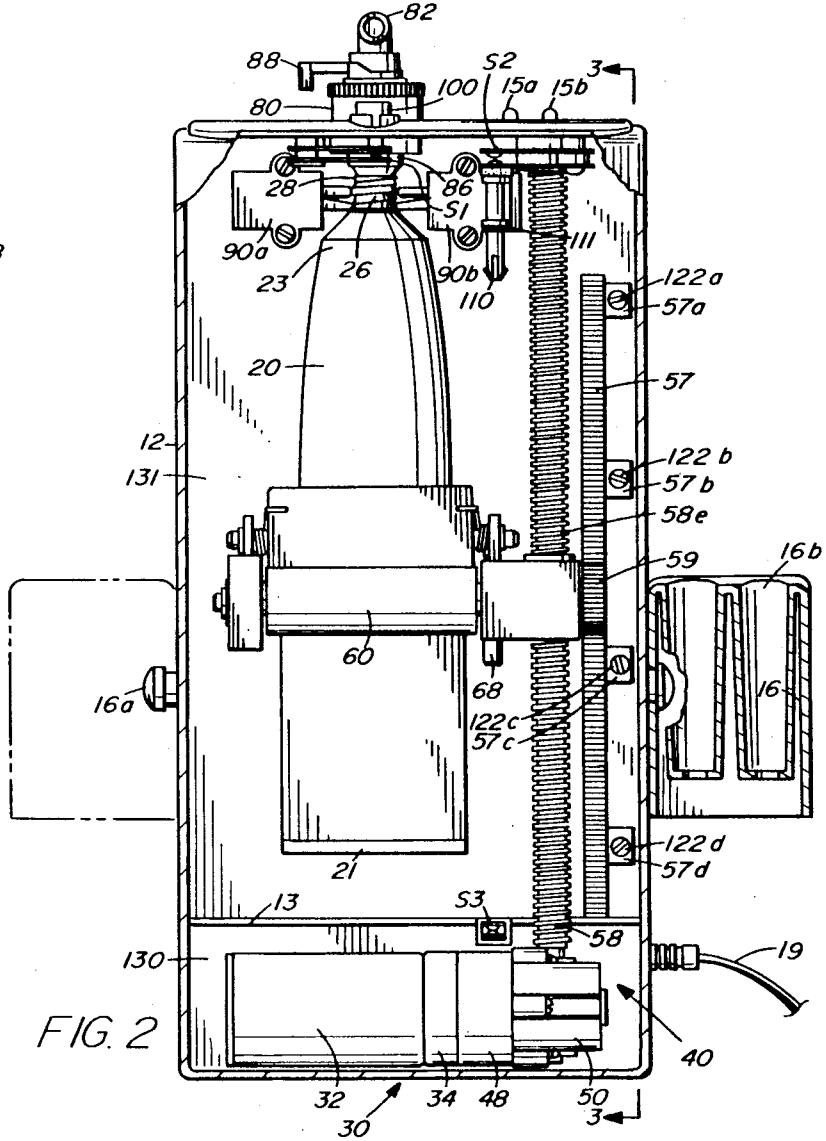
FIG. 2 is a front elevational view taken along section line 2—2 of FIG. 1 to show the interior of the housing.
Figure 1:
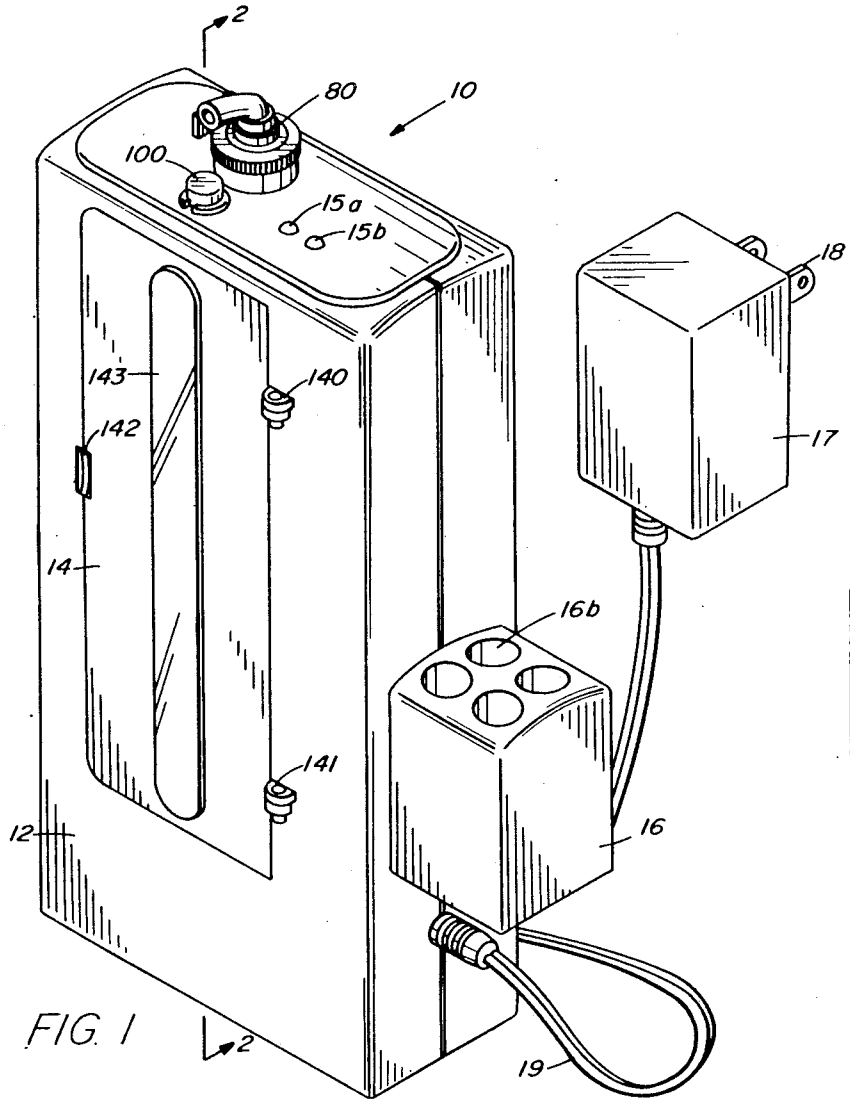
FIG. 1 is a perspective view of the toothpaste dispenser.

Referring now to the drawings, and more particularly to FIG. 1, there is shown the electric toothpaste dispenser apparatus 10. Referring now to FIG. 2, the electric toothpaste dispenser 10 generally includes a housing 12, a toothpaste container 20, a drive assembly 30, a carriage assembly 60, a nozzle assembly 80 and first and second grasping assemblies 90*a* and 90*b*.

Referring back to FIG. 1, the dispenser 10 includes a housing 12 with a door 14. The dispenser 10 also includes a toothbrush holder 16, a d/c converter 17 with a/c wall socket plug-in prongs 18 and electrical cord 19, a nozzle assembly 80 and a push button 100. Access to the interior region of the housing 12 is made through the door 14 which is large enough to allow the convenient insertion by hand of a toothpaste container or tube 20. The door 14 has two hinges 140 and 141 and a latch 142 which snaps into a groove in the housing 12 for holding the door 14 in a closed position. The door 14 also includes a window 143 for viewing the toothpaste container 20 so that a user can determine the brand and amount of toothpaste which has been used. The electric toothpaste dispenser 10 is activated by depressing the push button 100 with a toothbrush 22 or other device. This causes toothpaste 24 to be dispensed out of the nozzle assembly 80. Lights 15*a* and 15*b* are located on the housing 12. Light 15*a* is preferably blue and turns on when toothpaste 24 is being dispensed through the nozzle assembly 80. Light 15*b* is preferably red and turns on when the toothpaste container 20 is empty.

Figure 3:
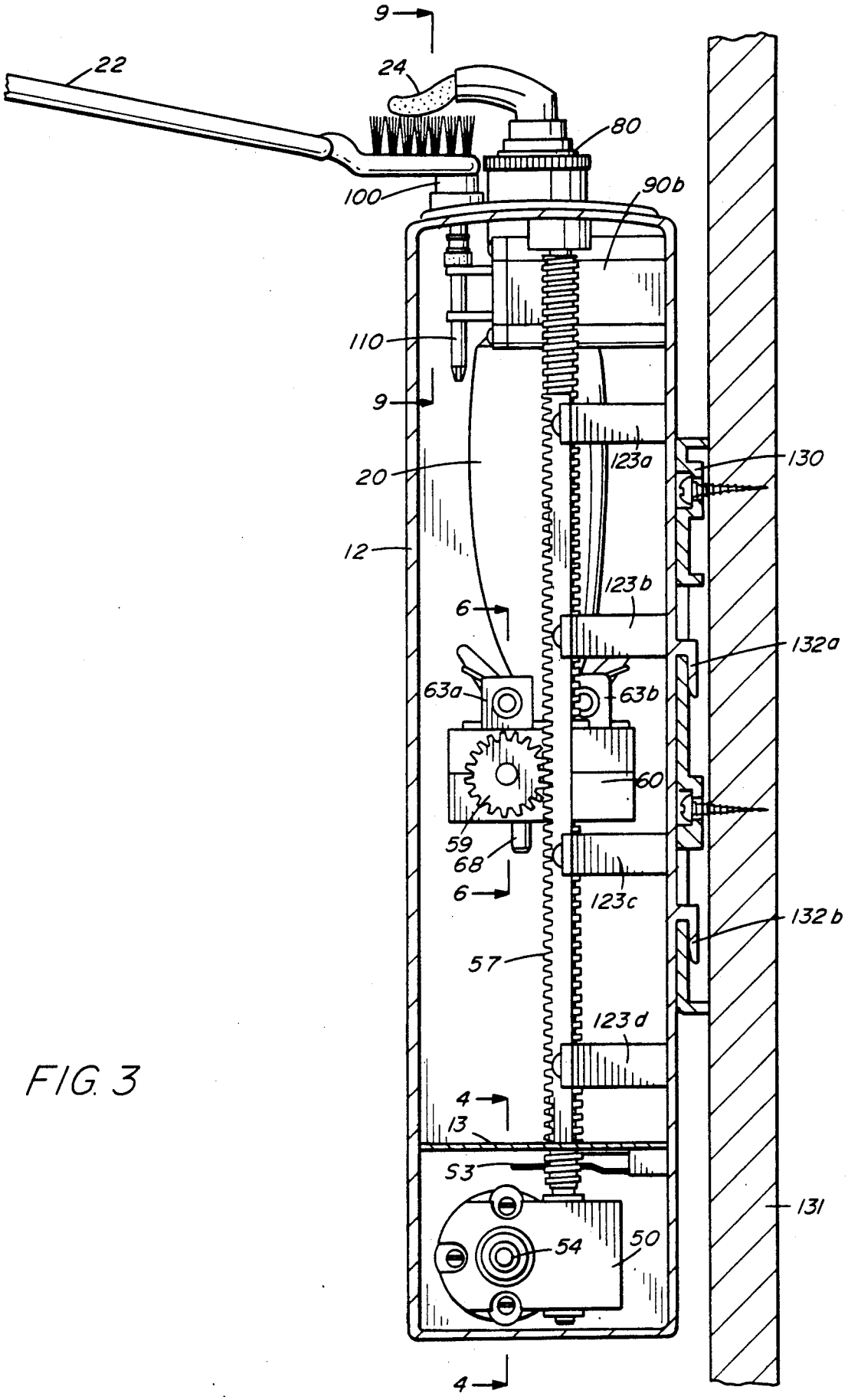
FIG. 3 is a side elevational view of the dispenser taken along section line 3—3 of FIG. 2.

Referring now to FIGS. 2 and 3, the interior of housing 12 is shown. A wall 13 separates a lower section 130 of the housing 12 from an upper section 131. Drive assembly 30 generally includes motor 32 and gear train 40. Gear train 40 transfers drive or torque to carriage assembly 60.

Current from the d/c converter 17 runs through the cord 19 into the lower section 130 for powering motor 32. When the push button 100 is depressed it will close the first switch S1 which turns on light 15*a* and activates the motor 32 in the forward or toothpaste dispensing direction. A frame 34 is attached to the end of the motor 32. The other end of the frame 34 is attached to a planetary gear 48 which is in turn attached to a gear box 50. The internal components of the gear box 50 transfer torque or drive to a long screw 58. When the long screw 58 is rotated it will transfer torque to or drive carriage assembly 60. More specifically, carriage assembly 60 will move along threads 58*e* causing pinion 59 to turn on rack 57 which is installed parallel to the long screw 58. The rack 57 is attached to the housing 12 with screws 122*a*, 122*b*, 122*c* and 122*d* which are threaded through rack mounting supports 57*a*, 57*b*, 57*c* and 57*d* and into casings 123*a*, 123*b*, 123*c* and 123*d* which are affixed to the housing 12. The pinion 59 transfers torque or drive to the carriage assembly 60. As the carriage assembly 60 rides up the length of the long screw 58 it will squeeze toothpaste out of the toothpaste container 20. When the carriage assembly 60 approaches the top of the toothpaste container 20 it will force toggle bar 110 to strike or close reverse switch or second switch S2. The reverse switch S2 will turn on light 15*a* and automatically activate the motor 32 in the reverse direction such that the carriage assembly 60 will ride downward until a prong 68 strikes or opens a third switch S3. In this position the carriage assembly 60 will rest below the lower end of the tube of toothpaste 20 so that the empty tube or container may be removed for disposal and a new container may be installed. The toothpaste container 20 is held around the neck 26 of the container 20 by a first and a second grasping assembly 90*a* and 90*b*.

The nozzle assembly 80 includes a lever 88 for the lowering of a tube fitting 86 into the mouth 28 of the toothpaste container 20. Once the tube fitting 86 is in place within or against the mouth 28 of the toothpaste container 20, toothpaste 24 can flow through the tube fitting 86 and out spout 82.

The toothbrush holder 16 could be mounted on either side of the housing 12 by any suitable means of attachment such as a hole and channel formed in the side of the toothbrush holder 16 for sliding over a projecting rivet head 16*a*. The toothbrush holder 16 has receptacles 16*b* for receiving toothbrushes 22. Referring to FIG. 3, the electric toothpaste dispenser 10 also includes a wall mount plate 130 which may be screwed or attached by other suitable means of attachment to a wall 131 or other structure. The mounting plate 130 has openings which receive prongs 132*a*, 132*b*, 132*c* (not shown) and 132*d* (not shown) fixed on housing 12. The prongs 132*a*, 132*b*, 132*c* and 132*d* are slid into the openings on mounting plate 130 and the housing 12 is lowered until the prongs 132*a*, 132*b*, 132*c* and 132*d* grasp around and the housing 12 rests on the mounting plate 130. Housing 12 may include other accessories.

Figure 4:
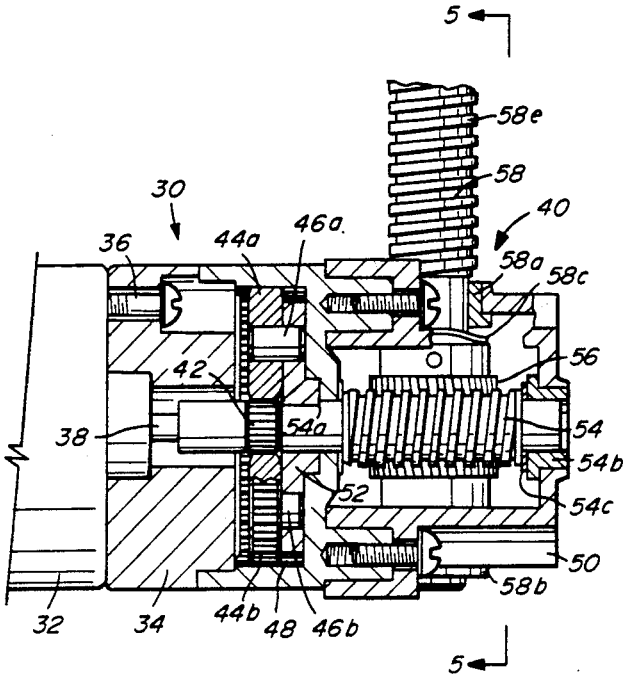
FIG. 4 is a detail view of the drive assembly taken along section line 4—4 of FIG. 3.
Figure 5:
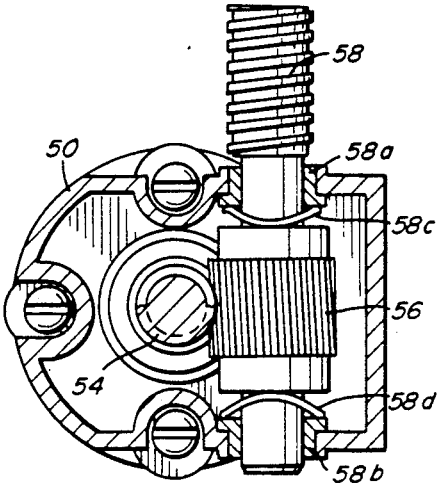
FIG. 5 is a detail view of the drive assembly taken along section line 5—5 of FIG. 4.

Referring to FIGS. 4 and 5, portions of the drive assembly 30 for driving carriage assembly 60 are shown. Frame 34 is attached by a screw 36 to the motor 32. The drive shaft 38 driven by the motor 32 transmits torque to gear train 40 through a pinion gear 42 located at the other end of the drive shaft 38. Gear train 40 ends with long screw 58.

The pinion gear 42 meshes with three idle gears 44*a*, 44*b* and 44*c* (not shown) which are equiangularly arranged around the pinion gear 42. Opposite the point of contact between the idle gears 44*a*, 44*b* and 44*c* *k*the pinion gear 42, the idle gears 44*a*, 44*b* and 44*c* mesh with a planetary gear 48. The planetary gear 48 remains stationary. The idle gears 44*a*, 44*b* and 44*c* are pinned to a revolution disc 52. As the pinion gear 42 drives the three idle gears 44*a*, 44*b* and 44*c* the idle gears 44*a*, 44*b* and 44*c* will rotate about their central axis on shafts 46*a*, 46*b* and 46*c* (not shown) as well as orbit within the planetary gear 48. Revolution disc 52 is seated within but does not mesh with the planetary gear 48. Hence, the orbital motion of the idle gears 44*a*, 44*b* and 44*c* will cause the revolution disc 52 to turn. The revolution disc 52 has a keyed opening in the center for engaging a notch 54*a* in worm gear 54. The worm gear 54 is supported at the other end by a worm bush 54*b*. The worm gear 54 transmits torque to a worm wheel 56. Worm wheel 56 is pinned or attached by other suitable means over the end of the long screw 58. A gear box 50 is attached to the planetary gear 48 for enclosing the worm gear 54 and the worm wheel 56 and holding the worm bush 54*b* in place. A washer 54*c* is placed between the worm bush 54*b* and the worm gear 54. The gear box 50 also contains two long screw bushes 58*a* and 58*b* for support of long screw 58. Wave washers 58*c* and 58*d* are placed between the long screw bushes 58*a* and 58*b* and the worm wheel 56.

Figure 7:
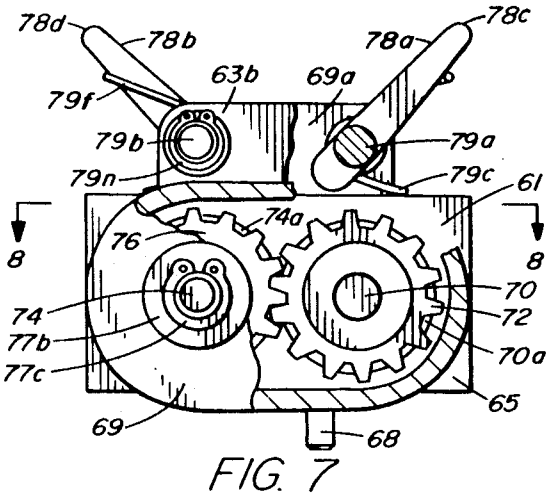
FIG. 7 is a detail view partially broken along section line 7—7 of FIG. 6.
Figure 6:
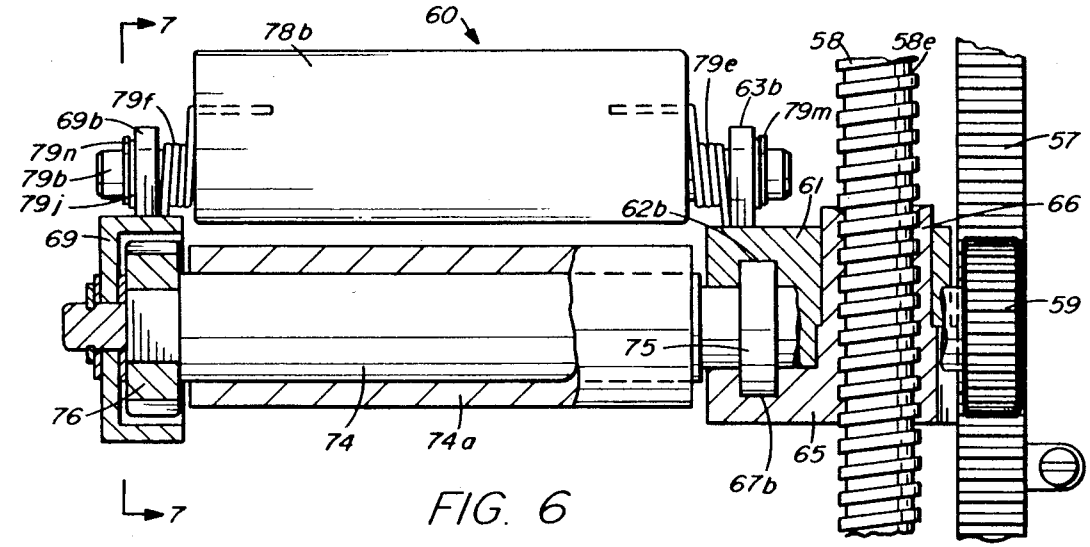
FIG. 6 is a detail view partially broken along section line 6—6 of FIG. 3.
Figure 8:
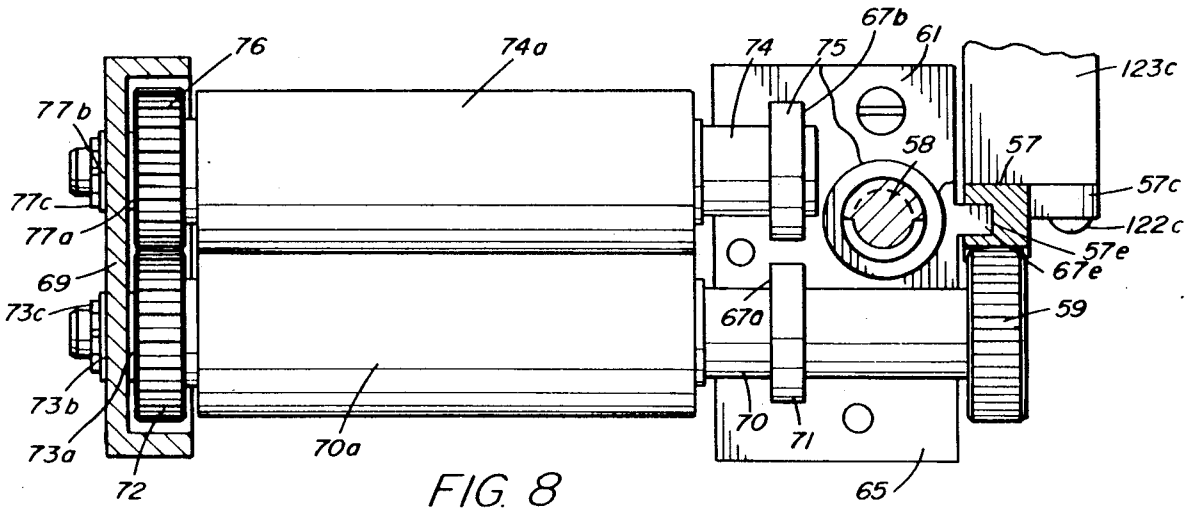
FIG. 8 is a detail view partially broken along section line 8—8 of FIG. 7.

Details of the carriage assembly 60 are shown in FIGS. 6, 7 and 8. The carriage assembly 60 generally includes an upper bracket 61, a lower bracket 65, a first roller 70, a second roller 74, a roller gear box 69, roller padding 70*a* and 74*a* and first and second guide plates 78*a* and 78*b*.

The lower bracket 65 has a vertical neck 66 having a threaded aperture for engaging the long screw 58 and has lower bearing cavities 67*a* and 67*b* for supporting and guiding both the first roller 70 and the second roller 74. A prong 67*e* on lower bracket 65 rides in guide channel 57*e* of rack 57 for stabilization of carriage assembly 60. The upper bracket 61 has a vertical bore therethrough which seats over the outer circumference of the neck 66 of the lower bracket 65, upper bearing cavities 62*a* and 62*b* for supporting and guiding both the first and the second rollers 70 and 74 and bearing walls 63*a* and 63*b* having holes for support of both the first and second guide plates 78*a* and 78*b*.

As the long screw 58 is driven, the threading in the neck 66 will ride upon the long screw threading 58*e*. The neck 66 is long enough to engage approximately twenty-six millimeters of the long screw 58 in order to stabilize the carriage assembly 60. The roller wheels 71 and 75 in both the first and second rollers 70 and 74 are supported within the bearing cavities 62*a* and 62*b* and 67*a* and 67*b* of the upper and lower brackets 61 and 65 when the brackets are attached together by screws or other suitable means of attachment. As best seen in FIG. 8, both brackets 61 and 65 include a continuous cavity 62*a* and 67*a* therethrough to accommodate first roller 70 and a partial cavity 62*b* and 67*b* to support the roller wheel 75 of the second roller 74.

A pinion 59 is attached to the first roller 70 at one end. A first roller drive gear 72 is pinned or attached by other suitable means to the other end of the first roller 70. A second roller drive gear 76 is pinned or attached by other suitable means to the other end of the second roller 74. The first roller drive gear 72 meshes with a second roller drive gear 76. Additionally, each roller 70 and 74 is coupled to its respective drive gear 72 and 76, preferably by a hex shaped bore (not shown) in each drive gear 72 and 76 which engages a hex shaped shaft section (not shown) on each roller 70 and 74. A roller gear box 69 is pinned over the ends of the first and second rollers 70 and 74 between two washers 73*a* and 73*b* and 77*a* and 77*b* and retained by clips 73*c* and 77*c*. The roller gear box 69 has two lower holes for support of the first and second rollers 70 and 74 and two upper bearing walls 69*a* and 69*b* having holes for support of the first and second guide plates 78*a* and 78*b*. As the long screw 58 turns, the upper and lower brackets 61 and 65 will move together in either an upward or downward direction depending upon the respective forward or reverse drive being provided by the motor 32. During this upward or downward motion of the brackets 61 and 65, contact between the rack 57 and pinion 59 will impart motion to the first roller 70. The first roller 70 drives the second roller 74.

Both rollers 70 and 74 are covered with roller padding 70*a* and 74*a* which is made of a pliable material such as rubber, foam or foam rubber. The pliable material is useful for guiding the toothpaste container 20 between the rollers 70 and 74 when the carriage assembly 60 begins at the bottom 21 of the toothpaste container 20, for obtaining a better squeeze on the toothpaste container 20 and for rolling over creases and other obstructions on toothpaste containers 20 of various sizes.

The distance between the rollers 70 and 74 and the thickness of the padding 70*a* and 74*a* creates a sufficient squeeze upon the toothpaste container 20 to remove the toothpaste while not impeding the motion of the rollers 70 and 74 and the carriage assembly 60. The open space between the rollers 70 and 74 when covered with padding 70*a* and 74*a* is preferably 0.5 millimeters and the thickness of the pads is preferably 2.5 millimeters.

Both the first guide plate 78*a* and the second guide plate 78*b* are attached to pins 79*a* and 79*b* which ride and are clamped within the holes on the upper bracket 61 and the roller gear box 69. Leaf springs 79c, 79d, 79e and 79f are seated at both ends of the guide plates 78a and 78b to urge the guide plates 78a and 78b to an angle of approximately 45° from the horizontal. Washers 79g, 79h, 79i and 79j are located on pins 79a and 79b which are retained by clips 79k, 79l, 79m and 79n. However, the guide plates 78a and 78b may be rotated against the force of the leaf springs 79c, 79d, 79e and 79f to a horizontal position. The guide plates 78a and 78b help to guide the lower end 21 of the toothpaste container 20 to the open space between the first and the second rollers 70 and 74 when the carriage assembly 60 starts at the bottom 21 of the toothpaste container 20.

The guide plates 78a and 78b function to direct a toothpaste container 20 which is not installed parallel to the axial direction of the first and second rollers 70 and 74 to the open space between such rollers when the carriage assembly 60 begins at the bottom 21 of a new container of toothpaste 20. A toothpaste container 20 may be installed such that the major cross-sectional axis of the container is anywhere within a 360° range of the axial direction of the first and second rollers 70 and 74. The guide plates will force the toothpaste container to rotate so that the major cross-sectional axis will be parallel to the axial directions of rollers 70 and 74 except in one situation. This situation occurs when the bottom 21 of the toothpaste container 20 is wider than the upper ends of guide plates 78a and 78b when the guide plates 78a and 78b are forced to the horizontal position. In this situation the angular range that the toothpaste container 20 can be rotated away from the axial direction of the first and second rollers 70 and 74 and still be rotated or guided between such rollers will be decreased to an angle where the bottom 21 of the toothpaste container 20 is within the extremities of the width between the upper ends 78c and 78d of guide plates 78a and 78b when the guide plates 78a and 78b are in the horizontal position.

The guide plates 78a and 78b are also useful for guiding a slightly bent toothpaste container to the open space between the padded rollers 70 and 74 as well as guiding a toothpaste container which is partially empty before being inserted within the electric toothpaste dispenser 10. Since the guide plates 78a and 78b are allowed to rotate toward a horizontal position against the force of the leaf springs 79c, 79d, 79e and 79f, the guide plates 78a and 78b will not obstruct the approach of the carriage assembly 60 to the top of the housing 12. This allows the rollers 70 and 74 to roll to the top 23 of the toothpaste container 2 before the second switch 112 is closed thus minimizing the amount of toothpaste left within the toothpaste container 20 before the drive assembly 30 is reversed in direction.

A toggle bar 110 is seated within a toggle bar holder 111 which is attached by screws or other suitable means of attachment to the housing 12. When the carriage assembly 60 has reached the top 23 of the toothpaste container 20, the upper bracket 61 will drive the toggle bar 110 up to close the second switch S2. The second switch S2 automatically reverses the drive assembly 30 causing the carriage assembly 60 to ascend or ride back down the length of toothpaste container 20 until the prong 68 on the lower bracket 65 strikes the third switch S3 which turns the motor 3 off. At this time light 15b will be activated to inform a user that a new toothpaste container 20 should be installed.

Figure 9:
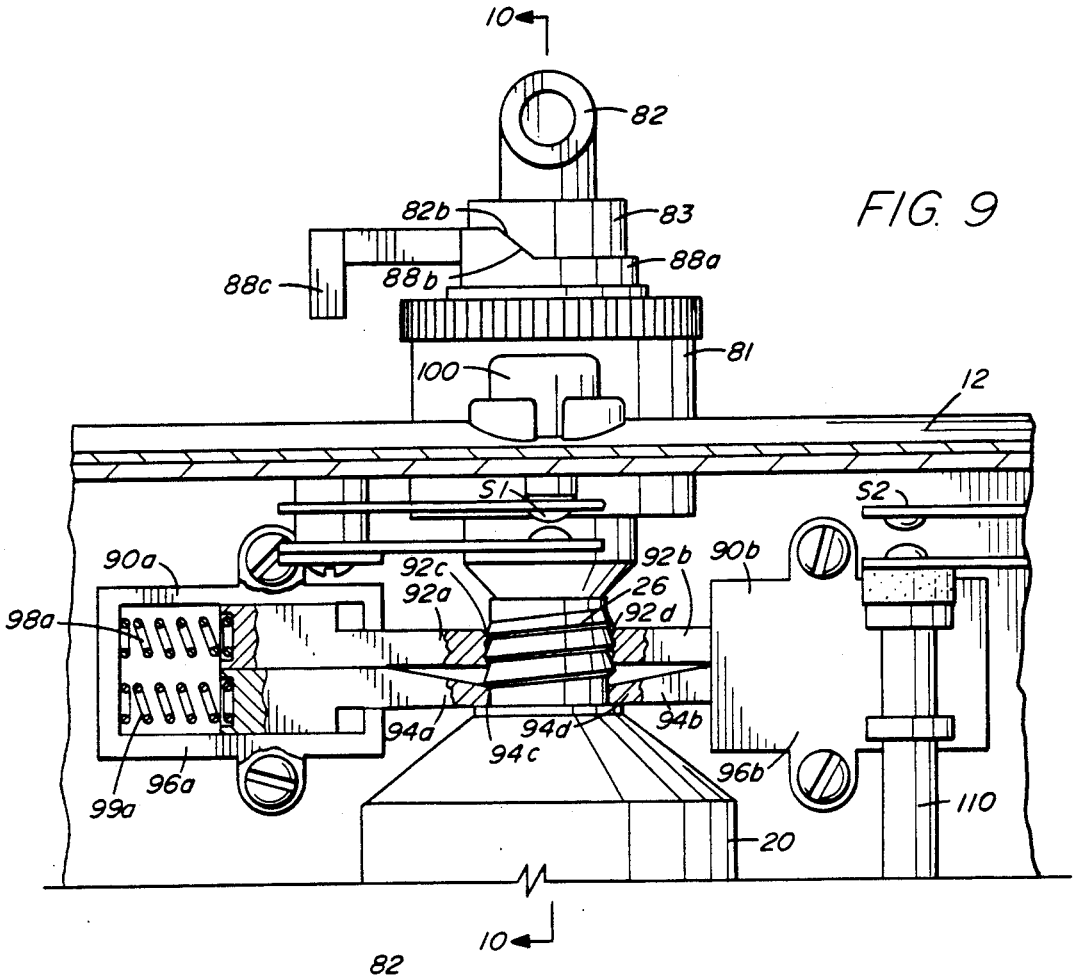
FIG. 9 is a detail view taken along section line 9—9 of FIG. 3 showing one grasping assembly in cross-section.

Referring now to FIG. 9, the details of the grasping assemblies 90a and 90b are shown. Both grasping assemblies 90a and 90b include an assembly housings 96a and 96b, respectively, which are attached by screws or other suitable means of attachment to the housing 20. Both grasping assemblies 90a and 90b include upper and lower clamps 92a and 92b and 94a and 94b, respectively. Both the upper clamps 92a and 92b and the lower clamps 94a and 94b are held together within the assembly housings 96a and 96b which restrict both vertical motion and motion in a direction perpendicular to the plane of the FIG. 9 drawing. However, the clamps 92a and 92b and 94a and 94b are allowed to move horizontally upon compression springs 98a and 98b and 99a and 99b which urge the clamps 92a and 92b and 94a and 94b, respectively, in opposing directions. Ends 92c and 92d on the upper clamps 92a and 92b, respectively, are concave to mesh with the threaded neck 26 of the toothpaste container 20. Ends 94c and 94d on the lower clamps 94a and 94b, respectively, are concave to grasp under the threads and around the neck 26 located on typical American toothpaste containers. In some situations depending upon the design of the toothpaste container 20, only either the upper or the lower clamps 92a and 92b or 94a and 94b will The user of the electric toothpaste dispenser 10 is able to operate the grasping assemblies 90a and 90b merely by reaching within the housing and pulling the upper and lower clamps 92a and 92b and 94a and 94b apart and either removing or inserting a toothpaste container 20. Since the grasping assemblies 90a and 90b are spring loaded they will adjust or adapt to the neck size of the toothpaste container 20 installed.

Figure 10:
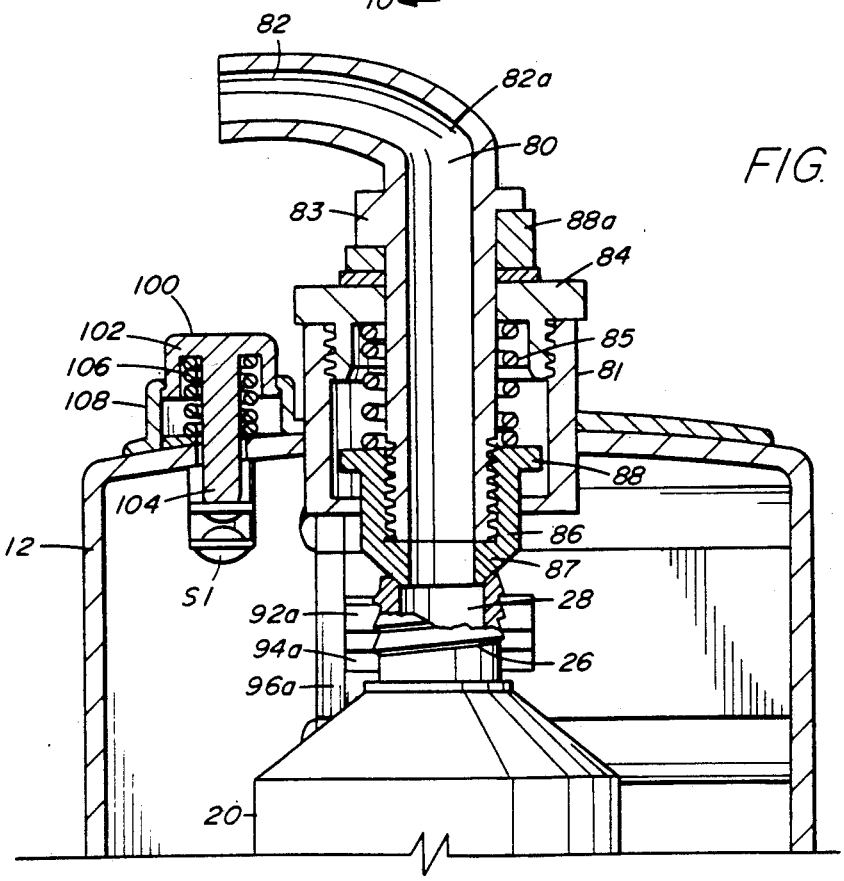
FIG. 10 is a detail view partially broken along section line 10—10 of FIG. 9.

FIGS. 9 and 10 show details of the nozzle assembly 80 and the push button 100. The push button 100 has a cap 102 and a downwardly extending prong 104. A compression spring 106 is seated over the prong 104 and compressed between the cap 102 and the housing 12 to hold the push button 100 in an upright position against a retainer 108. In this position the first switch S1 will be open. When the push button 100 is depressed the prong 104 will close the first switch S1. This will activate the motor 32 in the forward direction to drive the carriage assembly 60 up the toothpaste container 20.

The nozzle assembly 80 includes a cup cover 84, a nozzle adjustment lever 88c, a spout 82, a tube fitting 86 and a spring 85. A cup 81 is threaded at its upper end for attachment of the cup cover 84 and has an opening at the lower end to allow the tube fitting 86 to pass therethrough. The cup 81 is affixed to the top of the housing 12. The spout 82 has an elbow 82a to deliver the toothpaste 24 to an area over or above the push button 100. A shoulder 83 is located just below the elbow 82a. The nozzle adjustment lever 88c, cup cover 84 and spring 85 are seated over the lower end of spout 82 and held in place between shoulder 83 and tube fitting 86 which is threaded to the lower end of spout 82. The tube fitting 86 has a conical neck portion 87 for lowering, adapting or connecting to the mouth 28 of the toothpaste container 20 mounted within the housing 12. This allows for toothpaste container mouths of various sizes to be accommodated. The upper end of the tube fitting 86 includes a flange 88. This flange 88 limits the downward motion of the tube fitting 86 when the flange 88 contacts the bottom of the cup 81. Spring 85 forces the tube fitting 86 downward to maintain contact with the mouth 28 of the toothpaste container 20 while toothpaste 24 is being dispensed from the container 20.

As shown in FIG. 9, the nozzle adjustment lever 88c has a collar 88a which fits around the spout 82. A portion of the collar 88a has an inclined surface 88b which wedges against the inclined surface 82b on the spout 82. Thus by moving lever 88c, the spout 82 will adjust or move in an axial direction either to lower or raise the tube fitting 86 from the mouth 24 of the toothpaste container 20.

At times toothpaste can dry within the spout 82 causing the spout 82 to be blocked. When this occurs the nozzle assembly 80 may be removed for soaking in warm water or for dislodging in some other manner. Nozzle assembly 80 is removed by unscrewing cup cover 84 from cup 81.

There are two problems which the present invention overcomes as the carriage assembly 60 ascends or descends along the toothpaste container 20. The first problem occurs when the toothpaste container 20 collapses either diagonally or toward the nozzle assembly 80. The second problem occurs when the neck 26 of the toothpaste container 20 is pulled out of The first and second grasping assemblies 90a and 90b. Both problems are affected by vibration and non-vertical forces exerted by the rollers 70 and 74. However, the first problem is primarily created by the exertion of too much vertical force in the upward direction, and the second problem is primarily created by the exertion of too much vertical force in the downward direction.

The interaction between the long screw 58, brackets 61 and 65, rack 57, pinion 59 and padded rollers 70 and 74 creates a smooth rolling motion along the toothpaste container 20 and makes the vibration and non-vertical forces negligible as compared to the rigidity of the toothpaste container 20 and the holding and stabilization abilities of the grasping assemblies 90a and 90b.

The upward and downward forces on the toothpaste container 20 are created by rollers 70 and 74 as carriage assembly 60 ascends or descends along the toothpaste container 20 and created by frictional contact between the padded rollers 70 and 74 and the toothpaste container 20. In the present invention these forces tend to balance each other out. However, the resilient mounting of the tube fitting 86 in nozzle assembly 80 will maintain contact with the mouth of the toothpaste container 20 and the holding and stabilization abilities of grasping assemblies 90a and 90b will hold the neck 26 regardless of any net force exerted by rollers 70 and 74 due to the ascending or descending motion of carriage assembly 60 and friction.

The present invention is also designed so that the rate of ascension or descension of the carriage assembly 60 and the rotational speed of rollers 70 and 74 will squeeze or compress the toothpaste container 20 to obtain a desirable flow rate of the toothpaste 24 out of the nozzle assembly 80.

The drive assembly or motor 30 operates at a speed of 5000 rotations per minute. Through the motor 32 and gear system 40 the long screw 58 is driven at 34.5 jrotations per minute. The carriage assembly 60 either ascends or descends 1 millimeter per revolution of the long screw 58 depending upon the direction that motor 32 is driven. This results in the carriage assembly 60 moving at a rate of 34.5 millimeters per minute or 0.575 millimeters per second. Although other drive assemblies 30 may be devised and used, this illustrates the preferred drive speed of the carriage assembly 60 in order to obtain a desirable flow rate of toothpaste 24 out of the spout 82 and in order to hold the container 20 in place without causing container 20 to collapse or be jarred from grasping assemblies 90a and 90b.

Figure 11:
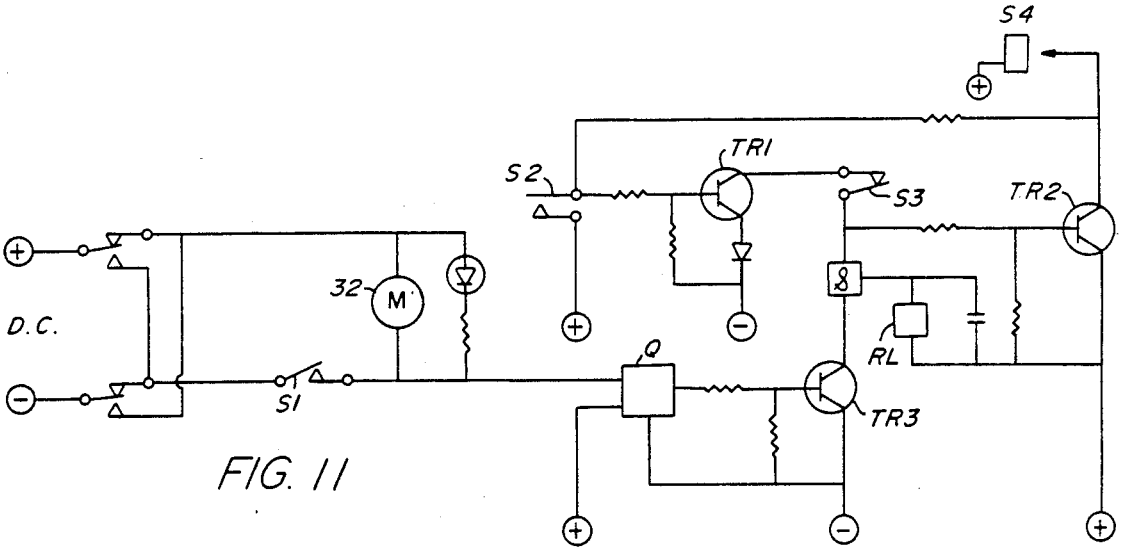
FIG. 11 is a schematic diagram of the electrical circuit employed for controlling the toothpaste dispenser of FIG. 1.

Referring to FIG. 11, circuitry for the control system of the present invention is shown When the first switch S1 is closed the circuit is completed and the motor 32 will start running in the forward direction to squeeze toothpaste out of the toothpaste container 20. When the push button 100 is released and the first switch S1 is open, activating pulse signal generating device Q sends a signal which turns on the third transistor $TR_3$ and the third transistor $TR_3$ in turn puts the relay RL into motion. This reverses the direction of the motor 32 which causes the carriage assembly 60 to descend. The amount of time that the third transistor $TR_3$ sends the signal to the relay RL in order to reverse the motor 32 is predetermined and adjustable. It is preferred that this amount of time be set at 0.5 seconds or approximately thereabout. This automatic reversal feature which operates for a set predetermined amount of time once the push button 100 is released is designed to release any pressure on the toothpaste container 20 to prevent excess leakage of the toothpaste 24 from the nozzle assembly 80 once the push button 100 is released.

When the toggle bar 110 closes the second switch S2, the relay RL will be set into operation through the contact point of the transistor $TR_1$ and the third switch S3. In this position the motor 32 will run in the reverse direction. The transistor $TR_2$ stays in the "on" position by its self-maintaining circuit until it is restored to the original position. When the carriage assembly 60 "bottoms" the third switch S3 is opened. This turns the second transistor $TR_2$ off and the RL is restored to its normal condition. Consequently, the original state of the circuit system is recovered.

Figure 12:
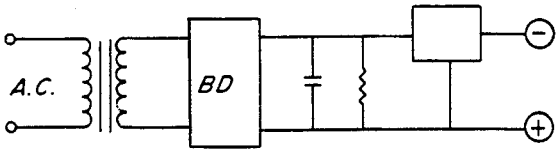
FIG. 12 is a schematic diagram of the d/c converter employed in the toothpaste dispenser of FIG. 1.

In some situations it may be desirable to reverse the direction of the motor 32 before the second switch S2 is closed. One such situation will occur when a user wishes to replace a container 20 of toothpaste or to rearrange the positioning of the toothpaste container 20. This manual reversal of the motor 32 can be achieved by reaching within the housing 12 and raising the toggle bar 110 by hand to close the second switch S2. As an option, a fourth switch S4 (shown only in FIG. 11) could be added to the exterior of the housing 12 in order to manually reverse the motor 32. FIG. 12 illustrates the preferred circuitry for the d/c converter.

The preferred embodiment of this invention has been shown and described above. It is to be understood that minor changes in the details, construction and arrangement of the parts may be made without departing from the spirit or scope of the invention as claimed.

What is claimed is:

1. A toothpaste dispensing apparatus having a housing which contains a toothpaste container, comprising:

a long screw;

a means for driving which drives said long screw;

a carriage assembly defining at least two bearing cavities for supporting a first and a second roller and a threaded hole through which said long screw passes for driving said carriage assembly;

a rack fixed to the housing parallel to said long screw;

a first pinion driven by said rack as said carriage assembly is driven by said long screw for driving said first roller;

means for grasping the toothpaste container for holding and stabilizing the toothpaste container within the housing; and control means located on the housing for activating said drive means.

2. The toothpaste dispensing apparatus having a housing which contains a toothpaste container according to claim 1, wherein said driving means is automatically reversible.

3. The toothpaste dispensing apparatus having a housing which contains a toothpaste container according to claim 1, further including a first and a second pliable pad which cover said first and said second rollers, respectively, to provide a uniform and pliable squeeze to the toothpaste container.

4. The toothpaste dispensing apparatus having a housing which contains a toothpaste container according to claim 3, wherein said carriage assembly further includes means for guiding the toothpaste container to an open space between said first and said second pliable pads which cover said first and second rollers, respectively.

5. The toothpaste dispensing apparatus having a housing which contains a toothpaste container according to claim 4, wherein said guiding means comprises a first guide plate mounted above said first roller and a second guide plate mounted above said second roller.

6. The toothpaste dispensing apparatus having a housing which contains a toothpaste container according to claim 1, wherein said grasping means is adaptable to toothpaste containers of various sizes.

7. The toothpaste dispensing apparatus according to claim 6, wherein said adaptable grasping means comprises:

a first assembly housing and a second assembly housing mounted within the toothpaste dispenser housing;

a first clamp slidably mounted within said first assembly housing and a second clamp slidably mounted within said second assembly housing; and a first compression spring mounted with said first assembly housing and a second compression spring mounted within said second assembly housing for urging said first and said second clamps in opposing directions for grasping the toothpaste container.

8. The toothpaste dispensing apparatus having a housing which contains a toothpaste container according to claim 1, further including a nozzle assembly at one end of the housing adaptable to the toothpaste container for the dispensing of toothpaste.

9. The toothpaste dispensing apparatus having a housing which contains a toothpaste container according to claim 1, further including a nozzle assembly at one end of the housing which comprises:

a spout;

a spring mounted tube fitting attached to the lower end of said spout, said tube fitting including a conical neck for adapting to toothpaste containers of various sizes whereby said tube fitting is adapted to and maintained in contact with the toothpaste container by the force exerted by said spring; a cover which threads to a cup affixed to the top of the housing whereby said cover unscrews from the cup for removing said nozzle assembly from the toothpaste dispenser;

said cover including a surface at an inclined plane; and a lever having a surface at an inclined plane for wedging against said surface on said cover whereby said spout and said tube fitting may be adjusted for connection to the toothpaste container.

10. The toothpaste dispensing apparatus having a housing which contains a toothpaste container according to claim 1, wherein said control means comprises:

a first switch located proximate a nozzle for driving said driving means in a forward direction;

a second switch located within and at one end of the housing which is automatically activated by said carriage assembly for reversing the direction of said driving means; and a third switch located at another end of the housing which is automatically activated by said carriage assembly to stop the reverse drive of said driving means.

11. The toothpaste dispensing apparatus having a housing which contains a toothpaste container according to claim 1, wherein said control means comprises means for automatic reversal of the drive direction of said driving means for a predetermined amount of time activated when a forward driving switch is released whereby pressure will be taken off the toothpaste container to prevent the dispensing of toothpaste.

12. The toothpaste dispensing apparatus according to claim 11, wherein said automatic reversal means reverses the drive direction of said driving means for approximately 0.5 seconds.

13. A toothpaste dispensing apparatus, comprising:

a housing which contains a toothpaste container;

a motor mounted in said housing for providing drive to the toothpaste dispenser;

means for transferring drive which is driven by said motor;

a first roller which is driven by said drive transfer means;

a second roller which is driven by said first roller; a first and a second pliable pad which cover said first and said second rollers, respectively, to provide a uniform and pliable squeeze as said rollers are moved along the length of the toothpaste container;

a first guide plate mounted above said first roller which guides the toothpaste container to an open space between said first padded roller and said second padded roller;

a second guide plate mounted above said second roller which guides the toothpaste container to said open space between said first padded roller and said second padded roller;

means for resiliently mounting said first guide plate over said first roller;

means for resiliently mounting said second guide plate over said second roller;

a first and a second grasping assembly mounted within said housing for holding and stabilizing the toothpaste container;

said first grasping assembly and said second grasping assembly each including at least one spring loaded clamp which are resiliently urged in opposing directions for grasping the toothpaste container;

a nozzle assembly having a spring loaded tube fitting for adapting to the toothpaste container; and control means located on said housing for activating said motor and for automatic reversal of said motor.

14. A toothpaste dispensing apparatus having a housing which contains a toothpaste container, comprising:

a drive assembly mounted in the housing for providing drive to the toothpaste dispenser;

means for squeezing and moving along the length of the toothpaste container which is driven by said drive assembly;

means for grasping the toothpaste container for holding and stabilizing the toothpaste container within the housing; and control means located on the housing for activating said drive assembly including means for automatic reversal of the drive direction of said drive assembly for a predetermined amount of time of approximately 0.5 seconds activated when a forward driving switch is released whereby pressure will be taken off the toothpaste container to prevent the dispensing of toothpaste.

* * * * *